United States Patent [19]

Pellegri

[11] Patent Number: 4,511,442

[45] Date of Patent: Apr. 16, 1985

[54] ANODE FOR ELECTROLYTIC PROCESSES

[75] Inventor: Alberto Pellegri, Luino, Italy

[73] Assignee: Oronzio de Nora Impianti Elettrochimici S.p.A., Milan, Italy

[21] Appl. No.: 609,536

[22] Filed: May 15, 1984

Related U.S. Application Data

[63] Continuation of Ser. No. 395,942, Jul. 7, 1982, abandoned.

[30] Foreign Application Priority Data

Mar. 26, 1982 [IT] Italy ..... 20407 A/82

[51] Int. Cl.[3] ..... C25B 1/34; C25B 11/04; C25B 11/12

[52] U.S. Cl. ..... 204/98; 204/128; 204/129; 204/294

[58] Field of Search ..... 204/98, 128, 129, 294

[56] References Cited

U.S. PATENT DOCUMENTS

| | | | |
|---|---|---|---|
| Re. 29,419 | 9/1977 | De Craene | 204/290 F |
| 2,978,401 | 4/1961 | Hoch et al. | 204/296 |
| 4,118,294 | 10/1978 | Pellegri | 204/129 |
| 4,191,618 | 3/1980 | Coker et al. | 204/98 |
| 4,197,178 | 4/1980 | Pellegri et al. | 204/255 |
| 4,217,401 | 8/1980 | Pellegri et al. | 429/39 |
| 4,278,525 | 7/1981 | Gestaut | 204/294 |
| 4,339,322 | 7/1982 | Balko | 204/294 |
| 4,350,608 | 9/1982 | Gestaut | 252/425.3 |
| 4,382,875 | 5/1983 | Solomon | 204/294 |
| 4,385,970 | 5/1983 | Skopp et al. | 204/294 |

*Primary Examiner*—R. L. Andrews

*Attorney, Agent, or Firm*—Pollock, Vande Sande & Priddy

[57] ABSTRACT

Anodes having a substantially impermeable coating or surface, obtained by moulding under pressure and heat an electrocatalytic layer consisting of a mixture of powders of an electrocatalytic material and inert thermoplastic resin on a conductive body or substrate, consisting of a mixture of powders of graphite and inert resin, resist surprisingly well to the electrochemical attack and offer significant advantages over the much more expensive activated titanium anodes.

14 Claims, 7 Drawing Figures

ANODE FOR ELECTROLYTIC PROCESSES

This application is a continuation of application Ser. No. 395,942, filed 7/7/82, now abandoned.

DESCRIPTION OF THE INVENTION

The present invention pertains to a new dimensionally stable anode, for electrolytic reactions in acidic and alkaline electrolytes, particularly suitable in electrochemical processes for decomposing electrolytes and recovering reaction products through the expenditure of energy, such as commonly effected in electrolysis cells.

In the last twenty years, the electrolysis field has recorded great technological advances due, to a large extent, to the introduction, on industrial scale, of dimensionally stable anodes, i.e. anodes which can be used for long periods of time without serious degradation or decomposition. Said anodes are characterized by a valve metal base, typically titanium, activated on its surface by means of noble metals or oxides thereof. In fact, this innovation has largely overcome the main problem which had always inhibited and conditioned many technological developments, that is the hitherto unavoidable consumption affecting the only anodic materials which could be economically utilized in the most important electrolytic processes, such as graphite for the electrolysis of halides and lead for the electrolysis of sulphuric acid solutions typical of electrometallurgy processes.

The peculiar characteristic of anodes made of titanium or other valve metal, such as tantalum or niobium, is in fact the capacity of said metals to passivate under anodic polarization and therefore not to dissolve anodically as do most of the common metals.

Graphite anodes consumption during operation occurs mainly by combustion with nascent oxygen, whose presence cannot be completely avoided in aqueous electrolytes even in the electrolysis of halides and moreover graphite has the tendency to form intercalation compounds with the anionic species discharging thereon, which leads to swelling and crumbling away of the outermost layers.

Obviously, graphite anodes could not be used suitably in those processes wherein oxygen evolution occurs at the anode as main anodic reaction, such as in the electrolysis of sulphuric acid solutions or alkaline solutions.

An excessive consumption of graphite is also experienced in the electrolysis of diluted halide solutions, such as in the electrolysis of sea water or synthetic brine for the production of hypochlorites or chlorates, because of the unavoidably considerable oxygen evolution taking place along with the main anodic reaction of halide evolution.

Very many attempts have been made in the past to activate the graphite surface by means of electrocatalytic deposits of noble metals oxides, which would allow reduction of the anodic over-potential and to reduce graphite consumption but no significant result has been achieved on a commercial scale. This may be due to the fact that the porosity of the deposits and the relatively high electrical resistance between the catalyst and the graphite do not efficaciously protect the underlaying graphite from anions discharge. On the other hand, the general adoption of valve metal anodes nowadays is greatly hampered by the fast rising of the price of titanium as well as other and even more expensive valve metals.

Titanium has become a base metal for aerospace constructions and its availability on the market is greatly reduced, causing its price to soar to such a leval as to make all to often economically unacceptable the use of titanium anodes in electrolysis plants, as an alternative to graphite or lead anodes.

Therefore, it has become necessary to look for new cheaper anodic materials as an alternative to valve metal, having the same characteristics of dimensional stability during operation and offering the ability to be reactivated on their electrocatalytic surface without discarding the whole anodic structure.

After research and overcoming prejudices ensuing from the known literature, the applicant has surprisingly found an anodic material, highly resistant to anodic corrosion and easy to be activated, which offers inert characteristics similar, if not in the mechanisms at least in the results, to those offered by the expensive valve metals.

Although the anodes of the present invention are mainly constituted by graphite or carbon, amorphous or at any convenient degree of graphitization, they may be successfully utilized even in electrolysis processes involving oxygen evolution, such as metal electrowinning from sulphuric solutions, wherein graphite and carbon per se are unsatisfactory.

Therefore, the anodes of the present invention besides offering dimensional stability and low cost, may be successfully utilized in various processes, in place of either titanium anodes or graphite or lead anodes.

The anode of the present invention is characterized by a current conducting body or substrate, constituted by a carbon base, preferably a mixture of electroconductive particles of graphite or carbon (amorphous or at any degree of graphitization) and of a chemically inert resin or polymer capable of being fused to produce a substantially impervious base. This base is coated at least on one surface thereof with an electrocatalytic layer composed of a fused mixture of particles of a chemically inert resin which may be the same as or different from the resin of the substrate and of at least one oxide of a metal or a metal itself belonging to the group comprising ruthenium, iridium, platinum, palladium, rhodium, manganese, cobalt, lead, iron, tin and nickel.

For electrocatalytic layer it is intended a layer permanently bonded or incorporated onto the current conducting supporting body having low electrical resistivity through its thickness and low overvoltage to the discharge of anions.

This layer is sufficiently thick as to protect the interior graphite base and this is substantially impervious.

Preferably an impervious layer of chemically inert resin is applied onto the surfaces of the conducting body which are not coated by the electrocatalytic layer to protect or isolate such surfaces from anodic attack when the product is used as an anode.

The electrocatalytic layer provides for an anodic surface resistant to corrosion and to anions discharge with a low overvoltage (lower than that of the carbon base) also at high current density, therefore the oxides or mixed oxides of the above mentioned metals may be chosen taking into account the specific use to which the anode is directed. For example, ruthenium or iridium oxides or mixed oxides of ruthenium and titanium or iridium and titanium or tantalum are particularly advantageous for anodes which have to operate in the electrolysis of halides, while lead, manganese, ruthenium, cobalt, lead and iridium oxides are particularly suited for the electrolysis of sulphuric solutions. Moreover, iron, nickel, lead and manganese oxides are particularly suited for use as anodes for cathodic protection either in the ground or in sea water.

The electrocatalytic layer is also substantially impermeable and efficaciously prevents, to a large extent, direct contact between the graphite and resin conductive body and the electrolyte.

It has however been surprisingly found that, even when the graphite and resin mixture, constituting the conducting substrate of the anode of the present invention, becomes exposed to direct contact with the electrolyte, for example in areas not coated by the impervious chemically inert resin, due to manufacturing faults or to accidental removal of a portion of the coating or layer and wherein the conditions exist for the normal anodic consumption of graphite, the conducting substrate so exposed readily self-passivates, perhaps after some initial corrosion. This is thought to be due to the consumption of the exposed graphite particles which initial process leaves behind a layer or surface of the resin or polymer matrix, which layer or surface even if porous, actually contracts and finally stops further corrosion of the resin-graphite body.

Preferably, the size of the graphite particles constituting the molded graphite-resin body should be small. The experiments carried out indicated that the finer the graphite particles, the more effective is the self-passivation process.

Obviously, besides a certain minimum value of the size of the graphite particles, mixing and manufacturing of the anodes becomes more difficult. However, it has been observed that with graphite particles not larger than $100\times10^{-6}$ meters, the moulded conductive body has a self-passivation capacity which appears sufficient for various applications.

While for simplicity sake the term "graphite" is often used without any other characterizing attribute either throughout the description or in the claims, it is intended that, whenever used, this term includes also carbon under various degrees of graphitization, that is carbon exhibiting a crystallization degree less than 100% or even amorphous that is carbon with extremely low degree of crystallization so long as it is capable of forming an electroconductive base.

Chemically inert resin constitutes the binder for both the graphite particles of the conducting substrate and the oxide particles of the electrocatalytic layer. Furthermore, it may constitute also the insulating superficial or protective layer which may be perferably applied onto the surfaces of the conductive substrate which are not provided with the electrocatalytic layer.

The resin must withstand the severe oxidizing anodic conditions without deteriorating and must exhibit good fluidity properties at the melting point. It should also be fusible or sufficiently softenable under heat and pressure to cause its particles to merge together to produce an impervious mass.

Particularly suitable resins are thermoplastic fluorinated polymers (fluorocarbon polymers) such as polymers of vinylidene fluoride, polychlorotrifluoroethylene or vinyl fluoride or partically fluorinated copolymers of ethylene and propylene with polyvinyldene difluoride of ethylene and tetrafluoroethylene fluorinated copolymers, perfluoroalcoholoxides polymers and so on.

Typical commercial products of the type hereinabove described are for example:

PCFTE, produced under the trade mark of HALAR by Allied Chemical Corp., U.S.A.

FEP, produced under the trade mark of TEFLON FEP by Du Pont de Nemours Corp., U.S.A.

PVD or $PVF_2$, produced under the trade mark of KYNAR by Pennwalt Corp., U.S.A.

PFA, produced under the trade mark of TEFLON PFA by Du Point de Nemours Corp., U.S.A.

All of such polymers are inert to anodic attack or swelling. Thus they are free of or contain no significant amount of acid, amino or other like groups which increase compatibility with water and provide polymers or resins which are swelled or penetrated by water or aqueous solution. The inert polymers herein contemplated are solid usually in pulverulent form which either have a definite melting or flow temperature under heat and pressure or at least can be softened without significant decomposition under heat and pressure to cause the particles thereof to merge together and to form an integral sheet or layer which is essentially non porous or at least impervious to aqueous liquids with which it is inteded to be used.

The following description of this invention illustrates a particularly preferred process for preparing the anodes herein contemplated but it should be understood that modifications of such preferred process can be applied without departing from the scope of the invention.

According to the preferred process of the present invention the anode is manufactured in different stages since this staging of the manufacture permits a more careful control of the manufacturing conditions, than, for example, to thermoforming of the anode in a single agglomeration operation.

Therefore the powders of graphite, of the resin and of the catalytic oxides are first separately sifted by means of sieves having at least 30 meshes per centimeter in order to ensure an average grain size lower than $100\times10^{-6}$ meters and to break or separate out coarse agglomerations of particles.

The two mixtures of graphite and resin powders and of catalytic oxides and resin are separately blended. The resin content in the two mixtures may vary between a minimum of about 15% to a maximum of about 40% preferably not above 25% by weight. Below 15% the molded article begins to be excessively fragile while around 25 to 35% the electrical conductivity of the molded body begins to fall off.

While the preferred weight ratios between the conductive powder and the resin in both the graphite-resin mixture for the substrate and the catalyst-resin mixture for the catalytic layer are indicated as being substantially equal, it is to be noted that the carbon or graphite powder has an apparent density which is from 2 to 20 times less than the corresponding apparent density of the powders of the catalytic materials.

This means that the volumetric ratio between the resin and the catalyst powder in the catalytic surface layer is much greater, generally from 2 to 20 times or even higher, than the volumetric ratio between the resin and the carbon powder in the conductive substrate.

This provides for a more impervious and tighter bonded electrocatalytic layer with an improved "coverage" of the underlaying carbon substrate.

It has been found that the fact that in the electrocatalytic layer the volume of resin is much higher than in the substrate does not impair the electrical performance of the electrode; that is because of the relative thinness of the layer and because the electronic current path is essentially normal to the thickness of the layer, electric current passes through the catalytic layer into the carbon substrate without significant ohmic drop.

The conducting body and the electrocatalytic layer are separately pre-formed using the same mould or different moulds.

Preforming is carried out by distributing the necessary charge of mixed powders and pressing at ambient temperature at a moulding pressure, for example, in the range between 200 and 350 atmospheres. Preferably, pressing is effected by short successive press blows in order to help exhaustion or expulsion of entrained air from the mass. Preferably, the mould has a free stroke, that is without stops, so that the powder mass receives the whole pressure from the press. The thickness of the ultimate preform may be adjusted, in case of an excessive volume reduction, by adding a further quantity of the powder mixture and pressing again.

The thickness of the pre-formed conducting body may vary from some millimeters up to 20 or 30 millimeters.

The thickness of the pre-formed electrocatalytic layer may vary from a minimum of about 0.05 up to an approximate maximum of 2 or 3 millimeters.

These products may have any convenient length and width, for example 0.5 meters or more.

In order to facilitate handling of large size pre-formed layers, the electrocatalytic layer may be pressed over an aluminium foil for support. The aluminium foil can then be leached away with diluted caustic soda or otherwise removed after the anode or the preform has been fabricated.

The element constituting the anode, preformed as described above at toom temperature, attain a sufficient mechanical resistance, which permits them to be handled and stored with a minimum caution for indefinite time.

In order to prepare a final anode, for example able to operate as anode on only one surface, the preformed conducting body or substrate is placed on the bottom of a mould. Preferably, before placing the conducting body or substrate in the mould, a continuous sheet or film of the inert resin (unmixed with graphite or other conductor) may be disposed on the bottom of the mould, the resin being similar to the one used in the powder mixtures, the sheet or film thereof having a thickness in the range of 0.05 to 1.0 millimeters or other thickness adequate to isolate or protect the base from anodic attack.

The pre-formed electrocatalytic layer is then placed onto the upper surface of the preformed conducting substrate and the mould is closed.

The mould is heated up to the melting or softening point of the resin at the molding pressure or preferably at a slightly higher temperature than such softening temperature, taking care that the whole mass reaches said temperature so that the respective resins of the base and the outer layers can fuse together. At this point, pressure varying from 100 to 200 Atmospheres is applied for one or more minutes, simultaneously starting to cool the mass still under pressure. A certain pressure must be retained until the temperature decreases well below the melting point of the resin.

The mould is then opened and the anode is taken out and cooled down to ambient temperature.

By suitably knurling or otherwise roughening the internal surface of the mould cover used for the final hot forming of the electroconductive electrocatalytic surface, anodes are provided which advantageously offer a real active surface much greater than the projected or not roughened surface, with obvious advantages of reduced over-voltage at a given current density over a flat or smooth surfaced anode.

The maximum depth of said impressions on the electrocatalytic layer external surface should be less than the electrocatalytic layer thickness and should preferably not exceed about half of the thickness of the electrocatalytic layer in order not to break through the layer and reduce the coverage of the underlying graphite-resin substrate.

The nonconductive resin film disposed on the bottom of the mould is melted onto the surface of the conducting body during hot forming and provides for an efficacious insulation of the graphite of the conducting body from the electrolyte in the inactive back surface of the anode.

The required machining may be carried out on the insulated back surface, or on the sides, to fasten or attach one or more connectors to the anode to provide means for the electrical connection of the anode with an external electric potential.

Obviously an anode which has to operate on both surfaces, may be prepared by disposing a first preformed electrocatalytic layer on the bottom of the mould, then the pre-formed conducting base and then a second pre-formed electrocatalytic layer on top, followed by the pressing under heat as previously described.

The process for preparing the anodes may also be varied. For example, it is possible to eliminate the preforming step and to mould directly under heat by appropriately loading the mould with successive layers of powders mixtures.

It is also possible to bond the various layers to the conducting body after these layers and the conducting body have been completely formed under heat and to pressure, simply by heating the assembly again up to the required temperature and pressure.

Furthermore, preformed pieces or even accidentally broken pieces may be heated and pressed together in the mould to restore an integral anode.

Another practical system to re-utilize broken anodes or pieces thereof is to grind them to small pieces and then press again under heat obtaining thus a new anode.

Another process for preparing the anodes of the invention is to mould under heat the graphite-resin conducting body. The electrocatalytic layer may then be applied by hot spraying the resin and catalytic oxide mixture onto the surface of the conducting body. The hot spraying or electrostatic spray coating technique may be used also for coating the non activated surfaces of the anode with an insulating layer of resin.

It may also be convenient to use extrusion techniques to form the anodes of the invention.

A certain amount of carbon or graphite fibers or even glass fibers may be added to the mixture of graphite or carbon and resin powders in order to increase the mechanical resistance or strength of the conductive body, especially for large size anodes.

The description of specific embodiments of the invention proceeds with reference to the following figures.

Figure 1:
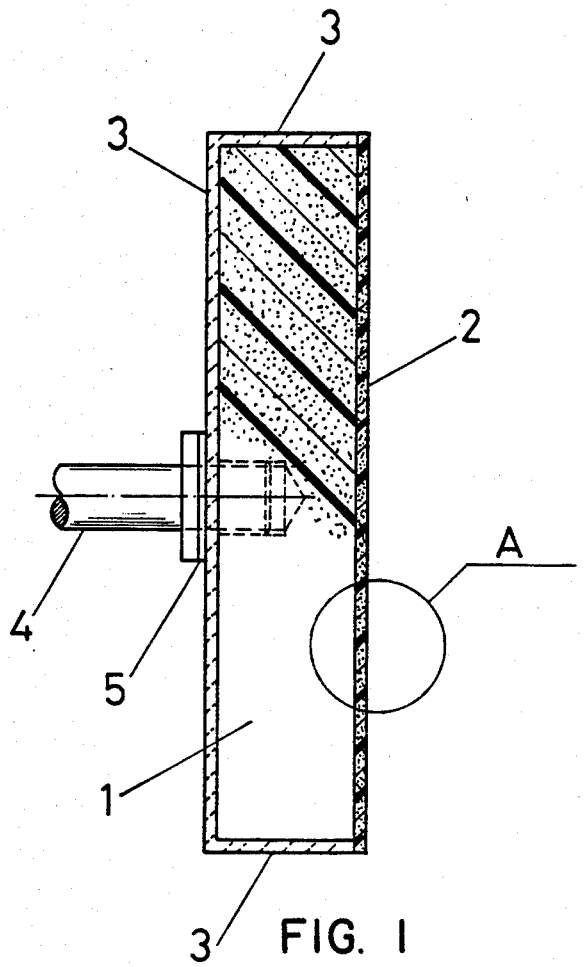
FIG. 1 is a cross-sectional view of an anode of the invention having an anodically active surface only on one side.
Figure 2:
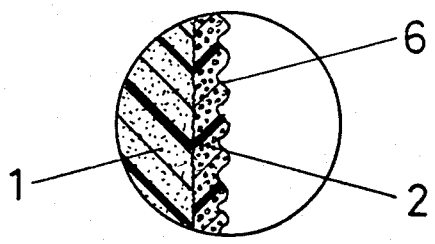
FIG. 2 is the magnified detail indicated by circle A in FIG. 1.

With reference to FIGS. 1 and 2, the anode is constituted by a conducting body 1, consisting of a graphite and resin aggregate thermoformed under pressure, coated on its active surface by an electrocatalytic layer 2, constituted by an aggregate of resin and an electrocatalytic oxide thermoformed under pressure.

The inactive surfaces of the anode are coated by an insulating layer of resin having no electroconductive material dispersed therein.

A current lead 4, made of titanium or other anodically resistant material, provides for the electrical connection of the anode to the electric source. Gasket 5 prevents electrolyte infiltrations inside the threaded coupling.

A certain roughness 6 impressed during moulding onto the external surface of the electrocatalytic layer 2 during forming, visible in the magnified detail of FIG. 2, permits increasing the real active surface of the anode. This roughening may be in any convenient form such as grooves, indentations, abrasions etc.

In order to better illustrate the invention, some practical examples of various embodiments and examples of utilization of the anodes of the present invention are reported herebelow.

EXAMPLE 1

In a cylindrical mould having a diameter of 40 millimeters various substrates were cold-preformed in the shape of discs with a thickness of 10 millimeters, pressing at room temperature and a pressure of about 300 Atmospheres a mixture containing 80% by weight of graphite powder: UCAR Grade 97-PF produced by Union Carbide U.S.A. and 20% by weight of KYNAR(R) Grade 461 powder produced by Pennwalt Corp. U.S.A. The powders were sifted through a sieve having 50 meshes per centimeter, before bleeding.

In the same mould various electrocatalytic layers were pre-formed in the shape of discs having a thickness ranging between 0.05 and 1 millimeters, pressing at room temperature and a pressure of about 300 Atmospheres a mixture containing 20% by weight of KYNAR(R) Grade 461 powder which is understood to be a polymer or copolymer of vinyldene fluoride and 80% by weight of various metal oxides powder as reported in Table 1.

The powders were sifted through a sieve having 50 meshes per centimeter, before blending.

Afterwards each of the preformed substrates, wrapped on its lower side and on the cylindrical side with a sheet of unreinforced Kynar(R) having a thickness of about 0.025 millimeters and containing no added material, was placed in the same mould and one of the electrocatalytic preformed layers was placed thereon.

The mould was closed and kept in a thermostatically controlled oven at 195°÷210° C. for at least 15 minutes and then withdrawn and quicly pressed at a pressure of about 100 Atmospheres, while cooling the mould down to at least 95° C. by means of compressed air. The mould was then opened and the anode withdrawn and cooled down to ambient temperature.

A threaded titanium connector was applied onto the insulated side of the anode as illustrated in FIG. 1.

The anodes thus prepared were labled as per the following table 1, which also reports the electrical resistance measured between the titanium connector and the active surface of the anode.

TABLE 1

| Anode Type | Oxide(s) in the Electrocatalytic Layer | Electrocatalytic Layer Thickness mm | Resistance between Anode Surface and Connector milliohms |
|---|---|---|---|
| A | $RuO_2$ | 0.1 | 17 |
| B | $IrO_2$ | 0.05 | 22 |
| C | PdO | 0.1 | 18 |
| D | $MnO_2$ | 0.2 | 27 |
| E | $PbO_2$ | 0.15 | 25 |
| F | $SnO_2$(50%) + $RuO_2$(50%) | 0.2 | 22 |
| G | CoO(40%) + $RuO_2$(10%) + $TiO_2$(50%) | 0.15 | 20 |
| H | $PtO_2$(40%) + $TiO_2$(60%) | 0.2 | 20 |
| I | $IrO_2$(40%) + $Ta_2O_5$(60%) | 0.1 | 18 |

One anode of the type A was sectioned and the junction between the conducting body and the electrocatalytic layer was observed under electronic microscope.

Figure 3:
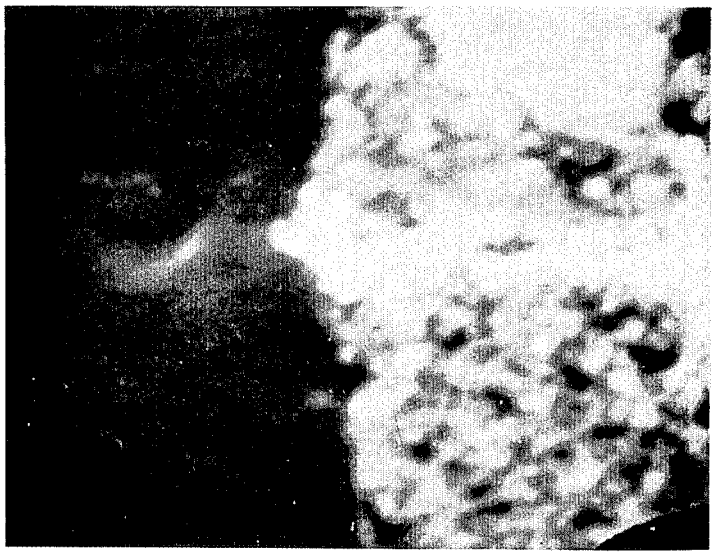
FIG. 3 is a microphotograph of the section of the anode of the invention.

FIG. 3 represents a microphotograph magnified 5000 times of the junction. The dark zone on the left represents the graphite and resin conducting body, while the lighter zone on the right represents the electrocatalytic layer containing no graphite.

Figure 4:
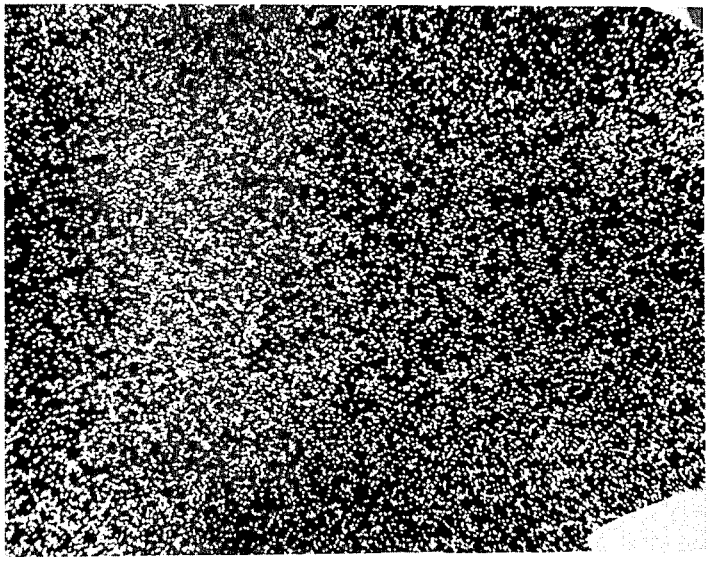
FIG. 4 is the X-rays flourine map of FIG. 3.

FIG. 4 represents the fluorine map, obtained by EDAX (Energy Dispersion Analysis by "X" rays) technique; showing the fluorine distribution of the same section of FIG. 3. The homogeneity of the fluorine map reflects the fluorine of the polymers binder and indicates that the resin is evenly distributed in both the conducting body as well as in the electrocatalytic layer.

Figure 5:
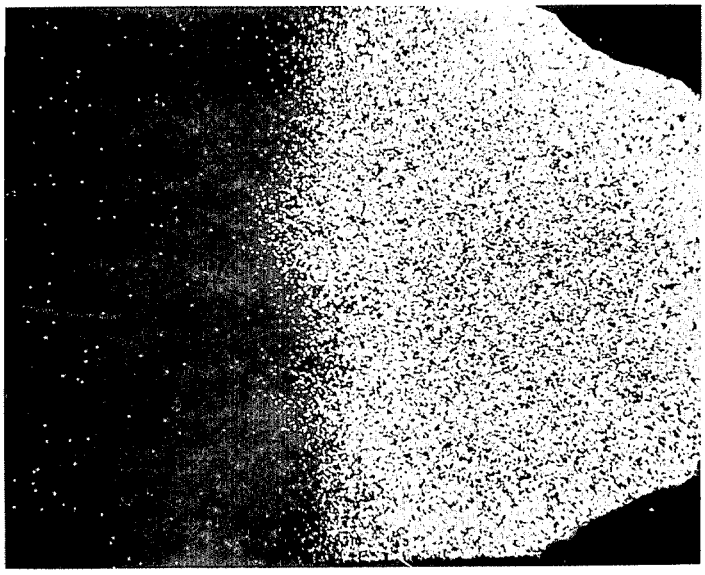
FIG. 5 is the X-rays ruthenium map of FIG. 3.

FIG. 5 represents the ruthenium map showing the ruthenium distribution of the same section of FIGS. 3 and 4. The graphite and resin conducting body (dark zone on the left of the photograph) are shown to be completely coated by the electrocatalytic layer, which is non porous and impermeable and consists essentially of ruthenium oxide and resin.

Therefore, the graphite of the conducting body is effectively protected from direct contact with the electrolyte, which can come into contact with an anodic surface constituted essentially of resin and ruthenium oxide.

EXAMPLE 2

Sample anodes of the type A, C, F, G and H prepared according to the method described in Example 1, were installed in a laboratory cell as an anode utilizing as counterelectrode (cathode) a disc having a diameter of 40 millimeters and a thickness of 2 millimeters, made of stainless steel AISI 316.

Electrolysis of an aqueous solution of sodium chloride was carried out in the laboratory cell under the following conditions:

| | |
|---|---|
| electrolyte concentration | 280 g/l (5 Molar) |
| electrolyte temperature | 25° C. |

After a few hours of operation the polarization curves of the various anodes have been recorded.

Figure 6:
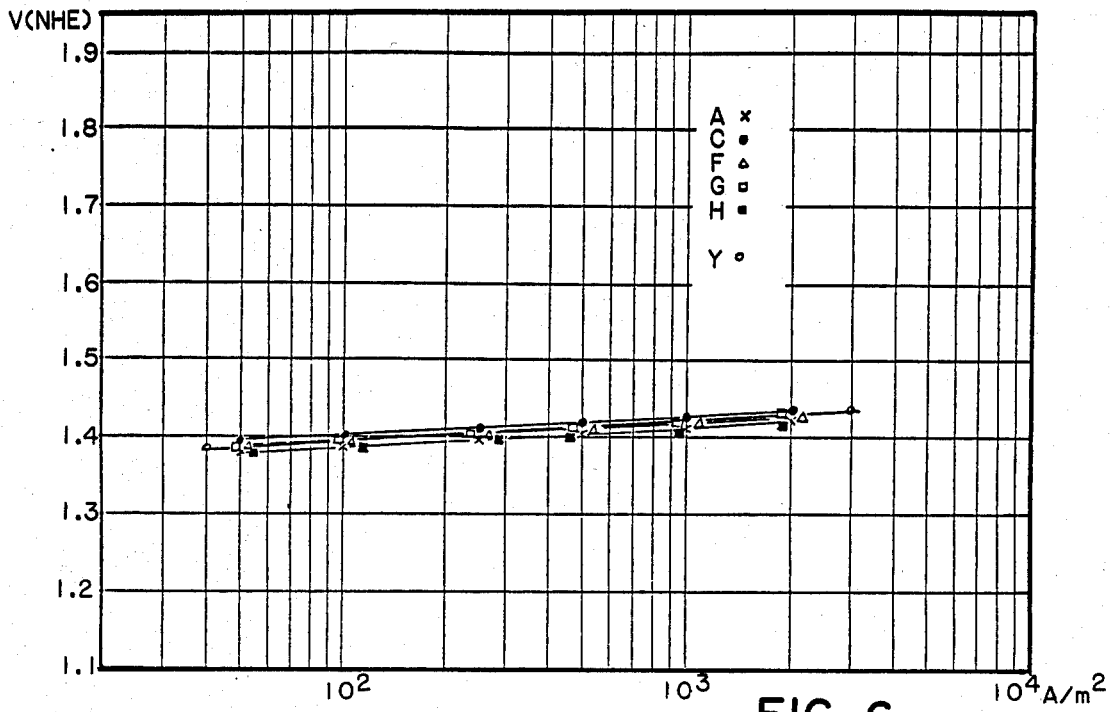
FIG. 6 shows the polarization curves of various anodes prepared in accordance with the present invention, obtained in NaCl brine.

FIG. 6 illustrates the polarization curve detected for each type of anode, that is the individual electrode potential at various current densities.

REFERENCE EXAMPLE 2 BIS

An activated titanium anode was tested in the same laboratory cell and under the same electrolysis conditions of Example 2. The anode consisted of a disc having a diameter of 40 millimeters and a thickness of 2 millimeters, made of titanium coated on one surface by a deposit constituted by a layer of about $5\times10^{-6}$ meters of mixed oxide of ruthenium and of titanium, respectively in the proportions of 45% and 55% by weight referred to the metals, obtained by thermal decomposition of a solution of chlorides of the metals according to the known technique.

Also for this reference anode the polarization curve has been detected and reported in FIG. 6 where it is indicated by the letter Y.

The catalytic activity of the anodes of the present invention appears quite comparable to that of the reference titanium anodes, while for some anodes, such as for type A and type H, it is even slightly better.

EXAMPLE 3

With the object of assessing the chemical stability of the graphite-resin substrate under the conditions of brine electrolysis, the electrocatalytic layer of a sample anode of the type A was milled off in a circular zone of the diameter of 4 millimeters on the active anode surface, having a diameter of 40 millimeters, in order to expose the graphite and resin conducting body to the direct contact with the electrolyte.

The anode was left working under the same electrolysis conditions of example 2, at a current density of 2000 Amperes per square meter.

After 960 hours of operation, no cell voltage increase nor any surface modification, either on the active surface or on the circular zone wherein the electrocatalytic layer had been taken off, was detected.

It is thought that, in the electrolysis of sodium chloride brine carried out at the conditions of the aforesaid example, the anodic potential on the electrocatalytic layer remains well below the evolution potential of oxygen and of chlorine on the graphite of the conductive substrate, which remains perfectly protected even if directly exposed to the electrolyte in some portions of the anode surface.

EXAMPLE 4

Sample anodes of the type A, B, D, E, F and I, prepared as described in Example 1, have been installed on a laboratory cell, utilizing as counterelectrode (cathode) a titanium disc having a diameter of 40 millimeters and a thickness of 2 millimeters.

Electrolysis of sulphuric acid (one molar) has been carried out at a temperature of 25° C.

Figure 7:
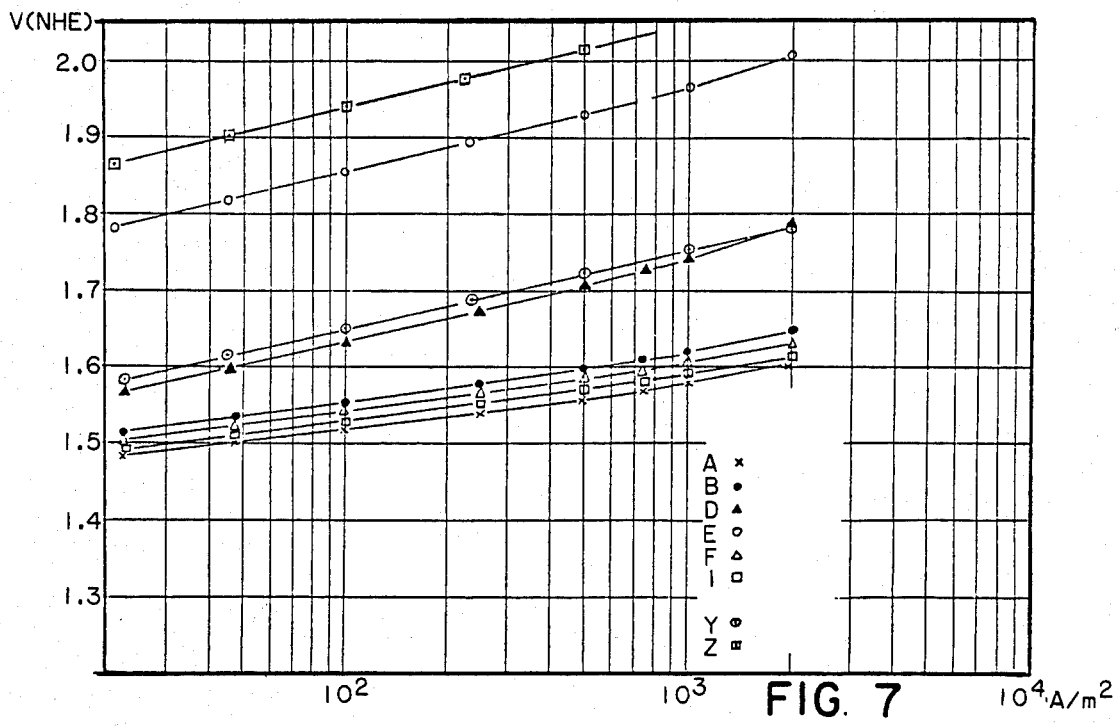
FIG. 7 shows the polarization curves of various anodes prepared in accordance with the invention, obtained in sulphuric acid.

The polarization curves detected for each type of anode after some hours of operation are reported in FIG. 7.

REFERENCE EXAMPLE 4 BIS

An activated titanium anode and an untreated lead anode was tested in the same laboratory cell and under the same conditions of Example 4.

The titanium disc consisted of a disc having a diameter of 40 millimeters and a thickness of 2 millimeters coated on one side with a deposit of about $5\times10^{-6}$ meters of a mixed oxide of ruthenium (45%) and titanium (55%).

The polarization curves detected for said anodes are reported in Table 7, wherein Y indicates the polarization curve of the activated titanium anode and Z that of the lead anode.

From a comparison of the polarization curves, it stands out that the anodes of the present invention are far more active than the lead anode and some of them, particularly the anodes of the type A, B, F and I are even more catalytic than the activated titanium anode.

EXAMPLE 5

As in Example 3, the electrocatalytic layer of various anodes was milled off from a circular zone having a diameter of 5 millimeters, in the active surface of the anodes.

The anodes were left in operation at a current density of 1000 Amperes per square meter in one molar sulphuric acid at the temperature of 60° C. for different periods of time, inspecting the anodes after each period.

The results of such observations are reported in the following Table.

TABLE II

| Anode Type | After 250 hours | After 400 hours | After 1000 hours |
|---|---|---|---|
| A | No change | No change | No change |
| B | No change | No change | No change |
| D | Swelling of the uncoated central zone | Further swelling | No further swelling |
| E | Swelling of the uncoated central zone | Further swelling | No further swelling |
| F | No change | No change | No change |
| I | No change | No change | No change |

The results clearly show that for the anodes of the type A, B, F and I, that is those provided with a very active electrocatalytic layer and capable of discharging oxygen at the test conditions, at substantially lower potentials than the discharging potential of oxygen on graphite, the uncoated graphite and resin substrate is perfectly protected from oxygen discharge and therefore no degradation of the exposed graphite surface is observed.

For the anodes of the type D and E, wherein said electrochemical protection is not afforded as the discharging potentials on the electrocatalytic materials $MnO_2$ and $PbO_2$ are very close or higher than the discharging voltage of oxygen on the graphite, a certain initial corrosion (swelling) of the exposed surface of the electroconductive graphite and resin substrate takes place but said corrosion phenomenon tends to stop with time without causing anode failure.

Different sample anodes of the type D have been sectioned along a plane which divided diametrically the swelled zone and have been examined after 250, 400 and 1000 hours of operation under the testing conditions.

The sample which had been operating for 250 hours showed a swelling of the surface of about 0.4 millimeters with respect to the original plane and the circular zone presented an elastic and spongy layer about 1.5 millimeters deep.

The material around and underneath said spongy layer maintained unaltered its hardness and electrical conductivity characteristics and appeared completely unaffected.

The sample which had been working for 400 hours showed a swelled spongy layer having a thickness of about 2.2 millimeters and even more meaningfully the sample which had been working for 1000 hours presented a swelled spongy layer having the same thickness of 2.2 millimeters. That is, from 400 to 1000 hours of operation there has been practically no further corrosion of the uncoated layer of the graphite and resin conducting substrate.

The material below the swelled layer appeared completely unaffected, thus confirming the capability of the spongy layer to eventually stop further degradation of the conducting substrate of the anode.

Proceeding with the tests, it has also been verified that it is possible to repair zones accidentally corroded simply by completely removing the swollen spongy layer and hot spraying a mixture of resin and a catalytic oxide onto said zone, or distributing onto said zone a mixture of powders and pressing for some time with a tool heated to a temperature slightly higher (from 5° to 30° C.) than the melting temperature of the resin.

The anodes of the present invention may therefore efficaciously substitute the costly valve metal anodes in very many applications, ensuring all the same durability and dimensional stability of the anode, long life and a catalytic property equal or higher than that of the valve metal anodes and certainly widely higher than the more conventional lead or graphite anodes.

EXAMPLE 6

Following the same procedure described in example 1, an anode, having a diameter of 40 millimeters and a thickness of 5 millimeters provided with an electrocatalytic layer on both circular faces was prepared.

The electrode was prepared by disposing a first preformed electrocatalytic layer on the bottom of the mould, then the preformed graphite and resin conducting body and on top another preformed electrocatalytic layer, followed by moulding under heat at the same conditions as illustrated in Example 1.

Both electrocatalytic layers had a thickness of about 0.1 millimeters and consisted of a mixture containing 80% by weight of ruthenium oxide and 20% by weight of Kynar(R) Grade 461.

The electrode was used as a bipolar electrode in a laboratory cell, interposed between two terminal electrodes of the type A, prepared according to the procedure of Example 1.

The cell was then constituted by two unit cells electrically connected in series, one of which was formed of one of the terminal electrodes and one of the bipolar electrode faces and the other one was formed by the other face of the bipolar electrode and the other terminal electrode. The interelectrodic distances were both of 3 millimeters and the bipolar electrode hydraulically separated the two cells.

Electrolyte is circulated across each unit cell through an inlet hole and an outlet hole communicating with the interelectrodic space of the cell, made in the transparent plastic pipe containing the circular electrodes.

Both cells were fed with an aqueous solution containing about 30 grams per liter of sodium chloride at a negligeable velocity, corresponding to a flow of about 600 square centimeters of solution per hour.

The voltage applied to the two terminal electrodes was controlled to impress an electrolysis current across the two cells in series corresponding to a current density referred to the electrodes surface of 1000 Amperes per square meter and it was about 7.5 Volts.

Electrolysis gave rise to chlorine evolution at the anode and water reduction with subsequent hydrogen evolution at the cathode and the chlorine and the hydroxyl ions released combine through the known reaction to produce hypochlorite in the effluent solution.

In order to keep the cathodic surfaces clean, which as it is well known, readily become fouled by heavy deposits of calcium and magnesium hydroxides (since calcium and magnesium are unavoidably present in the unpurified salt solution) the polarity of the voltage applied to the terminal electrodes was reversed every 30 minutes by means of a suitable time-switch.

Therefore, on each electrodic surface of the two cells, every 30 minutes the reaction turned from anodic, that is chlorine evolution, to cathodic, that is hydrogen discharge.

After 1250 hours of operation no degradation of the electrodes was detected and the cell voltage was substantially unchanged. This has surprisingly demonstrated that the anode of the invention can easily tolerate even the cathodic discharge of hydrogen without any trouble.

REFERENCE EXAMPLE 6 BIS

In the same bipolar cell of example 6, the electrodes of the invention were replaced by other electrodes.

In the first case the electrodes utilized were constituted by titanium discs activated, according to the known technique, by a deposit of about 30 grams per square meter of mixed oxides of ruthenium and titanium with a content of ruthenium and titanium respectively of 45% and 55%.

Tested at the same conditions of example 6, the cell voltage triplicated after only 180 hours of operation.

The electrodes showed a loss of about 60% of the electrocatalytic layer and the titanium body, in the uncoated areas, appeared corroded.

Observed under microscope, the titanium body appeared coated by a superficial layer extremely fissurized containing titanium hydride in a large amount.

In a second test, the electrodes were constituted by titanium discs which, after the usual sandblasting and pickling treatments, were coated by an electrocatalytic layer consisting of a thermoformed mixture of ruthenium oxide powder (80%) and Kynar(R) Grade 461 (20%) with the thickness of about 0.1 millimeters.

The electrocatalytic layer was prepared and applied onto the titanium discs following the same procedure illustrated in examples 1 and 6, only that the graphite and resin conducting body had been substituted by the titanium disc.

At the same conditions of Example 6, a sharp voltage increase had been detected after 250 hours of operation.

The electrodes exhibited a broad delamination of the electrocatalytic layer from the titanium body.

In some areas the electrocatalytic $RuO_2$ and resin layer gave rise to bubblelike swell which, when strung and pressed, released a certain quantity of electrolyte.

In a third test the electrodes were constituted by machined graphite discs, whereon the same electrocatalytic layer of the previous tests had been applied following the same procedure as for the titanium discs.

At the same conditions of the example 6, also these electrodes failed after only 85 hours of operation. The electrocatalytic layer appeared completely detached from the graphite substrate, exhibiting an extremely poor adhesion degree to the graphite support.

Tests have been made using other commercially available fluorocarbon thermoplastic resins, as binder for both the conductive substrate and the electrocatalytic layer. All proved substantially satisfactory except for polytetrafluoroethylene (a fully fluoronated polymer) with which attempts to produce mechanically resistant bodies were unsuccessful, as also were the attempts to produce electrocatalytic layer of satisfactory stability.

This is believed to be due to the difficulty in melting or fusing the tetrafluoroethylene polymer under the molding conditions. In the practice of the present invention the thermoplastic fluorocarbon polymer (normally only partially fluoronated) in powder form ultimately fuse or melt or flow together to produce what appears to be a continuous and substantially impervious matrix incorporating the conductive particles. Thus the polymer particles merge producing substantially impervious mixtures with the powders which have few if any pores of channels extending to any substantial depth.

Due to the normally different melting temperature of commercial fluorocarbon resin powders, it generally is advantageous or preferable to use the same or substantially the same resin or polymer for the conductive substrate, for the electrocatalytic surface layer as well as for the optional insulating layer over the surfaces not coated by the electrocatalytic layer. This greatly simplifies the moulding together of the various pre-formed layers.

The anodes of the invention offer an extraordinary versatility that anodes of the prior art hardly possess. This is in virtue of the fact that the "homogeneous" matrix constituted by the thermoplastic resin binder, solves any adhesion problem between "non-homogeneous" layers.

This offers extraordinary advantages over, for example, the valve metal base anodes where adhesion of the electrocatalytic material may be only achieved through stringent crystallinity affinity between the valve metal oxide and the catalytic oxides, thereby limiting the selection of catalytic materials which are usable.

In fact, with the anodes of the invention any suitable catalytic oxide may be applied and more layers, even of different oxides, may be superimposed and moulded together on the conductive body.

For example, an intermediate layer of highly active oxide, such as, for example, ruthenium oxide may be disposed between the graphite-resin substrate and the outermost layer of, for example, lead oxide or manganese oxide for use in electrochemical processes wherein a higher oxygen overpotential is preferred. In this case the intermediate layer of ruthenium oxide or other highly catalytic oxide does not operate as anodic surface but serves to prevent any degradation of the graphite substrate even in those areas where the top layer of lead or manganese oxide is accidentally removed or missing.

While the invention has been discussed with particular reference to the use of metal oxides as the electroconductive surface or intermediate layer it is to be understood that other electroconductive compounds which are stable, have good electroconductivity and low overvoltage may be used. For example, lithium or calcium ruthenate, ruthenium carbide or nitrides or the corresponding compounds of other platinum group metals may be used in the electroconductive base or surface layer or intermediate layer in lieu of some or all of the metal oxide. Furthermore, metals such as platinum powder, palladium powder, silver powder or the like may be added to these mixtures such as those of the above examples in lieu of some or all of the metal oxide thereof.

The electrodes herein contemplated may be effectively used as anodes in the electrolysis of aqueous alkali metal halides for example for the generation of hypochlorite or chlorate solutions by electrolysis of sodium chloride solution or of sea water or like dilute halide solutions in cells without diaphragms. They may also be used as anodes in diaphragm chlorine cells electrolyzing hydrochloric acid or alkali metal chloride to produce hydrogen, chlorine and alkali metal hydroxide.

In Example 6 a test was described in which the electrode there described and having electrocatalytic low overvoltage coatings on both sides of the base served as a bipolar electrode between two cells units for electrolyzing sodium chloride to generate dilute hypochlorite solutions.

In that embodiment the carbon substrate with the conductive layer on both sides also serves as a wall to separate unit cells in a row of bipolar units. It may also be used as a backwall in other bipolar chlorine cells and serves to support electrodes which extend from opposite sides thereof.

The anodes herein contemplated may also be effectively used in the electrolysis of solutions of lead sulphate, zinc sulphate or copper sulfate for the electrodeposition of these metals from aqueous solutions usually sulfuric acid solutions thereof.

They may also be used for the electrolytic deposition of other metals such as iron, cobalt or nickel from their corresponding chloride or sulfate solutions or in the plating of articles with chromium from chromic acid solutions.

It will be noted that in the above examples the weight percent of conductor (graphite) in the base and of the electrocatalytic layer (ruthenium oxide or the like) is about the same for example 80% by weight. Since the actual density of the respective conductors is different, it will be apparent that the volume ratio of resin to conductor particles in the surface or electrocatalytic layer is lower that the volume ratio fo conductor to resin in the base. That is the volume ratio of resin to conductor is higher in the surface layer than in the base. Often the surface volume ratio of resin to conductor may range from 50 to 300% or more higher than the volume ratio of resin to conductor in the base. This higher relative volume ratio serves to protect the base and facilitate provision of an impermeable surface layer. At the same time the conductivity thereof is not seriously impaired because the coating is thin, preferably being less than 5 to 6 millimeters, rarely being in excess of 3 millimeters and the electric current path is perpendicular to the thickness of the coating.

The base on the other hand has good conductivity over the length and width thereof because of the higher volume ratio of graphite to resin therein.

On effective advantage of the anodes of the invention over the anodes of the prior art is that the catalyst is "supported" by the inert resin matrix and therefore its mechanical stability is not affected by the conductive substrate like what, for instance, happens with the ruthenium oxide coating on titanium of the well-known anodes which, under particular conditions, like accidental cathodic polarization with consequent hydrogen evolution or like oxygen discharge at relatively high current density, fails due to the hydridization or oxidation of the titanium substrate at the coating-titanium interface.

Although the present invention has been described with reference to certain particular embodiments thereof, it is not intended that such embodiments shall be regarded as limitations upon the scope of the invention, except insofar as included in the accompanying claims.

What we claim is:

1. Dimensionally stable anode for electrochemical reactions characterized in that it comprises an electroconducting body impermeable to aqueous electrolytes and to gases constituted by a thermoformed mixture of graphite particles and inert thermoplastic resin powders having on at least one side thereof an electrocatalytic layer impermeable to aqueous electrolytes and gases consisting of a mixture of inert resin and particles of an oxide of at least one of the metals belonging to the group of ruthenium, iridium, platinum, palladium, rhodium, manganese, cobalt, lead, iron, tin, and nickel, the inert thermoplastic resin of the electroconducting layer forming a homogeneous matrix through the cross-section of the anode whereby the graphite particles of the electroconducting body and the particles of an oxide of the electrocatalytic layer are each fused in a continuous resin matrix, and wherein said thermoplastic resin is capable of being fused to produce a substantially impervious body.

2. Anode of claim 1 characterized in that any surface of the conducting body which is not covered by the electrocatalytic layer which is impermeable to aqueous electrolytes and gases is coated by an impervious and insulating layer of resin.

3. Anode of claim 1 characterized in that the quantity of resin contained in the mixtures is comprised between about 15 and about 40% by weight.

4. Anode of claim 1 characterized in that the average diameter of the graphite particles is lower than $100\times10^{-6}$ millimeters.

5. An electrolytic cell electrode which comprises a carbon substrate having an electroconductive active substantially impermeable surface portion comprising electroconductive particles having a lower oxygen overvoltage than carbon bonded together by a fused thermoplastic inert fluorocarbon polymer capable of being fused to produce a substantially impervious body.

6. The electrode of claim 5 wherein the carbon substrate comprises carbon particles which are bonded together by an inert fused thermoplastic fluorocarbon polymer.

7. The electrode of claim 6 wherein the melting or softening point of the polymer of the substrate is substantially the same as that of the surface polymer.

8. A method of electrolyzing an aqueous solution which comprises conducting the electrolysis with at least one electrode comprising an electroconductive carbon substrate having an electroconductive substantially impervious surface comprising electroconductive particles having a lower oxygen overvoltage than carbon bonded together by a fused thermoplastic and inert fluorocarbon polymer capable of being fused to produce a substantially impervious body.

9. The method of claim 8 wherein the carbon substrate comprises carbon particles which are bonded together by a fused and inert fusible fluorocarbon polymer.

10. The method of claim 9 wherein the aqueous solution is acidic and the electrode is an anode.

11. The method of any of claims 8, 9 or 10 wherein the aqueous solution is a solution of a chloride salt and the electrode is an anode.

12. The method of any of claim 8, 9 or 10 wherein the aqueous solution is a salt of a metal which can be electrodeposited and the electrode is an anode.

13. A method of electrolyzing an aqueous electrolyte which comprises conducting the electrolysis in a cell having an anode which is impermeable to aqueous electrolytes and to gases and which comprises an electroconductive substrate comprising electroconductive particles bonded together by a fused thermoplastic resin resistant to the electrolysis and an electroconductive surface layer impermeable to aqueous electrolytes and gases comprising electroconductive particles of oxygen or chlorine overvoltage lower than the particles of the base bonded together by a fused thermoplastic resin resistant to said electrolysis, the volume ratio of resin to conductor being higher in the surface layer than in the substrate and wherein said thermoplastic resin is capable of being fused to produce a substantially impervious body.

14. The anode of claim 1 wherein the quantity of resin in the mixtures is no greater than 25% by weight.

* * * * *

UNITED STATES PATENT AND TRADEMARK OFFICE

CERTIFICATE OF CORRECTION

PATENT NO. : 4,511,442

DATED : April 16, 1985

INVENTOR(S) : Alberto Pellegri

It is certified that error appears in the above—identified patent and that said Letters Patent is hereby corrected as shown below:

Column 2, line 5, "leval" should be --- level ---.

Column 4, line 1, "perfluoroalcoholoxides" should be --- perfluoroalcohoxides ---.

Column 4, line 9, "PVD" should be --- PVDF ---.

Column 8, line 3, "quicly" should be --- quickly ---.

Column 8, line 10, "labled" should be --- labeled ---.

Column 15, line 46, "millimeters" should be --- meters ---.

Signed and Sealed this

*Twenty-fourth* Day of *September 1985*

[SEAL]

*Attest:*

*Attesting Officer*

DONALD J. QUIGG

*Commissioner of Patents and Trademarks—Designate*